US010207782B2

(12) United States Patent
Fahmie

(10) Patent No.: US 10,207,782 B2
(45) Date of Patent: Feb. 19, 2019

(54) WIND PADDLE SAIL ASSEMBLY AND METHOD FOR OPERATING THE SAME

(71) Applicant: John Archie Fahmie, Miami, FL (US)

(72) Inventor: John Archie Fahmie, Miami, FL (US)

( * ) Notice: Subject to any disclaimer, the term of this patent is extended or adjusted under 35 U.S.C. 154(b) by 0 days.

(21) Appl. No.: 15/646,599

(22) Filed: Jul. 11, 2017

(65) Prior Publication Data

US 2018/0009514 A1 Jan. 11, 2018

Related U.S. Application Data

(60) Provisional application No. 62/360,959, filed on Jul. 11, 2016.

(51) Int. Cl.

| | |
|---|---|
| ***B63H 9/04*** | (2006.01) |
| ***B63H 16/04*** | (2006.01) |
| ***B63H 16/10*** | (2006.01) |
| ***B63H 9/08*** | (2006.01) |
| ***A63C 17/12*** | (2006.01) |
| ***A63C 17/00*** | (2006.01) |
| ***B63H 9/06*** | (2006.01) |
| *B63B 15/00* | (2006.01) |
| *B63B 35/79* | (2006.01) |

(52) U.S. Cl.

CPC ..... *B63H 9/08* (2013.01); *A63C 17/0013* (2013.01); *A63C 17/12* (2013.01); *B63H 9/06* (2013.01); *B63B 15/0083* (2013.01); *B63B 35/7973* (2013.01); *B63B 2741/00* (2013.01); *B63H 9/0642* (2013.01); *B63H 16/04* (2013.01)

(58) Field of Classification Search

CPC ..... B63H 9/00; B63H 9/08; B63H 9/0642; B63H 2009/00; B63H 2009/08; B63H 2009/0642; B63H 16/04; B63H 2016/04; B63B 2741/00; A63C 17/12

USPC ..... 114/39.16, 39.17, 102.1, 102.11–102.16, 114/102.22, 102.44, 102.27, 102.28, 114/102.29, 108; 440/101–104

See application file for complete search history.

(56) References Cited

U.S. PATENT DOCUMENTS

| | | | | |
|---|---|---|---|---|
| 1,859,178 A * | 5/1932 | Sprinkle | A63C 3/00 114/102.11 |
| 3,120,211 A | 2/1964 | Mahan | |
| 4,344,377 A | 8/1982 | Gram | |
| 4,810,217 A * | 3/1989 | Bell | B63H 16/04 416/70 R |
| 4,926,772 A * | 5/1990 | Bright | B63B 35/7933 114/39.12 |
| 5,732,642 A | 3/1998 | Desilva | |
| 6,807,919 B1 * | 10/2004 | Thomsen | B63H 9/08 114/102.11 |
| 7,114,456 B2 | 10/2006 | Sohy | |

(Continued)

FOREIGN PATENT DOCUMENTS

DE 3908021 A1 8/1990

*Primary Examiner* — Daniel V Venne

(74) *Attorney, Agent, or Firm* — Laurence A. Greenberg; Werner H. Stemer; Ralph E. Locher

(57) ABSTRACT

A wind paddle sail assembly includes a sail having stiffened upper and lower ends and a paddle or pole having an upper fixed end and a lower portion with a lower free end. A fastener fastens the upper fixed end of the paddle or pole to the upper end of the sail. A downhaul strap fastens the lower end of the sail to the lower portion of the paddle or pole for adjusting tension in the sail. A method for operating a wind paddle sail assembly is also provided.

18 Claims, 19 Drawing Sheets

(56) References Cited

U.S. PATENT DOCUMENTS

| | | | | |
|---|---|---|---|---|
| 9,010,260 | B1 * | 4/2015 | Chen | B63B 35/7953 114/102.1 |
| 9,033,753 | B2 * | 5/2015 | Siverts | B63B 35/7959 114/39.11 |
| 2005/0045085 | A1 * | 3/2005 | Sawyer | B63H 9/06 114/102.11 |
| 2012/0247379 | A1 * | 10/2012 | Haller | B63B 35/71 114/39.11 |
| 2012/0318183 | A1 | 12/2012 | Chen | |
| 2013/0014683 | A1 | 1/2013 | Hoyt | |
| 2013/0340661 | A1 | 12/2013 | Siverts et al. | |
| 2017/0283022 | A1 * | 10/2017 | Seibert | B63H 9/0657 |

* cited by examiner

WIND PADDLE SAIL ASSEMBLY AND METHOD FOR OPERATING THE SAME

CROSS-REFERENCE TO RELATED APPLICATION

This application claims priority, under 35 U.S.C. 119(e), to U.S. Provisional Patent Application No. 62/360,959, filed Jul. 11, 2016. The prior application is incorporated herein in its entirety.

BACKGROUND OF THE INVENTION

Field of the Invention

The invention relates to a wind paddle sail assembly including a standard paddle or pole and a sail for steering and driving a land or water vehicle under wind power. The invention also relates to a method for operating a wind paddle sail assembly.

Description of the Related Art

U.S. Publication 2013/0014683 shows a rigid foil sail having independently adjustable sections. The sail is shown as being attached to a sailboat. U.S. Pat. No. 7,114,456 discloses an airfoil which may be attached to a boat, as shown in FIG. 9 thereof. U.S. Pat. No. 5,732,642 shows a sail which is attached to a windsurfing craft, as shown in FIG. 4. U.S. Pat. No. 4,344,377 also discloses a sail for a small craft. U.S. Pat. No. 3,120,211 shows a sail for a sailboat. German Publication DE3908021A1 discloses a sail for a water vehicle. All of the above-described devices disclose a sail to be attached to a watercraft in some way, which limits the location at which the sail can be used and therefore, in turn, limits the operation of the sail.

U.S. Publication 2013/0340661 discloses a sail which is stored in a shaft of a paddle having a blade at one end. The sail may be deployed out of the shaft to propel a board across the water. The sail is thus limited in size so that it can fit within the shaft and must be used with a specific paddle that is hollow and can accommodate the sail therein.

U.S. Publication 2012/0318183 shows a paddle with a sail attached to the paddle or to an operator's hands or wrists. The blade of the paddle is held against the side of a watercraft in the water. If the sail is connected to the paddle, a boom is required to hold the sail open and to operate the sail.

None of the prior art devices provide a wind paddle sail assembly which may be used completely free of a watercraft so that it can be raised in the air or placed in any position to catch the wind, which supports the sail so that the operator's hands are free to steer the sail and which may be used with any paddle or with any pole mast, rod or bar.

BRIEF SUMMARY OF THE INVENTION

It is accordingly an object of the invention to provide a wind paddle sail assembly and a method for operating the same, which overcome the hereinafore-mentioned disadvantages of the heretofore-known devices and methods of this general type, which allow a land or water vehicle to be easily propelled and steered by using the wind while not requiring attachment to the vehicle, which permit both hands to be used to steer the sail and which may be used with any paddle, mast pole or bar.

With the foregoing and other objects in view there is provided, in accordance with the invention, a wind paddle sail assembly, comprising a sail for propelling a land or water vehicle, such as a kayak, a stand-up paddle board or a skateboard. The sail has stiffened upper and lower ends. However, the lower end has some flexibility and is not as rigid as the top because it needs to bow slightly to make the sail tight. A shaft, such as a paddle or a mast pole, has an upper fixed end and a lower portion with a lower free end. A fastener, such as a pocket at the top of the sail, fastens the upper fixed end of the shaft to the upper end of the sail. A downhaul strap fastens the lower end of the sail to the lower portion of the shaft for adjusting tension in the sail.

With the objects of the invention in view, there is also provided a method for operating a wind paddle sail assembly. The method comprises providing a sail having stiffened upper and lower ends and a shaft, such as a paddle or a mast pole, having an upper fixed end and a lower portion with a lower free end. A fastener, such as a pocket at the top of the sail, fastens the upper fixed end of the shaft to the upper end of the sail. A downhaul strap is used to fasten the lower end of the sail to the lower portion of the shaft and the downhaul strap is used to adjust tension in the sail. Holding the lower portion of the shaft with one hand and steering the sail with the other hand while occupying a land or water vehicle, such as a kayak, a stand-up paddle board or a skateboard, propels and steers the vehicle with the wind.

According to one embodiment of the invention, the shaft is a paddle, a handle grip pocket is disposed at a lower end of the lower downhaul strap, and the handle grip pocket has a notched, U-shaped handle opening acting as a receptacle for receiving a T bar disposed at the lower free end of the paddle.

According to another embodiment of the invention, a mounting bar clamp is clamped to the shaft between the upper fixed end and the lower free end of the shaft, and a cordage anchor strap is attached between the mounting bar clamp and the lower downhaul strap.

The fastener or pocket disposed at the upper end of the sail and the shaft, paddle or pole and the handle grip pocket or mounting bar clamp disposed at the other end of the shaft, paddle or pole keep the sail in place so that the hands of the operator are free to steer the sail. This provide a great advantage over prior art devices in which the hands of the operator are required to hold a portion of the sail.

In accordance with a further embodiment of the invention, the downhaul strap includes an upper downhaul strap attached to the lower end of the sail, a lower downhaul strap attached to the shaft, and a release clip interconnecting the upper and lower downhaul straps, the release clip permitting adjustment of a length of the downhaul strap. The length of the strap defines the tension in the sail.

In accordance with an added embodiment of the invention, the lower downhaul strap is formed in one piece with a downhaul safety strap having a free end to which a carabiner clip is attached. This carabiner clip may be clipped to the upper downhaul strap to prevent the lower downhaul strap from falling into the water and becoming lost when the upper and lower downhaul straps are disconnected. A quick-release clip, a hook and loop fastener strap, such as a Velcro® strap or any other type of metal or plastic clip may be used instead of the carabiner clip.

These embodiments make it easy to accommodate a paddle having a T bar or a mast pole without a T bar and to adjust the length of the downhaul strap to the force of the wind.

In accordance with an additional embodiment of the invention, a yard pole pocket encloses a rigid yard pole at the upper end of the sail, and a foot pole pocket encloses a flexible foot pole at the lower end of the sail. The sail is thus provided with a shape permitting optimum usage in the wind without the operator holding the sail to give it the desired shape.

In accordance with a concomitant embodiment of the invention, the sail has a batten pocket, and a sail batten is disposed in the batten pocket. The batten also provides stiffness and a bow shape for the sail.

Other features which are considered as characteristic for the invention are set forth in the appended claims.

Although the invention is illustrated and described herein as embodied in a wind paddle sail assembly, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of the specific embodiment when read in connection with the accompanying drawings.

BRIEF DESCRIPTION OF THE SEVERAL VIEWS OF THE DRAWING

FIG. 4A is an enlarged view of the anchor strap having the cordage loop;

DETAILED DESCRIPTION OF THE INVENTION

Figure 1:
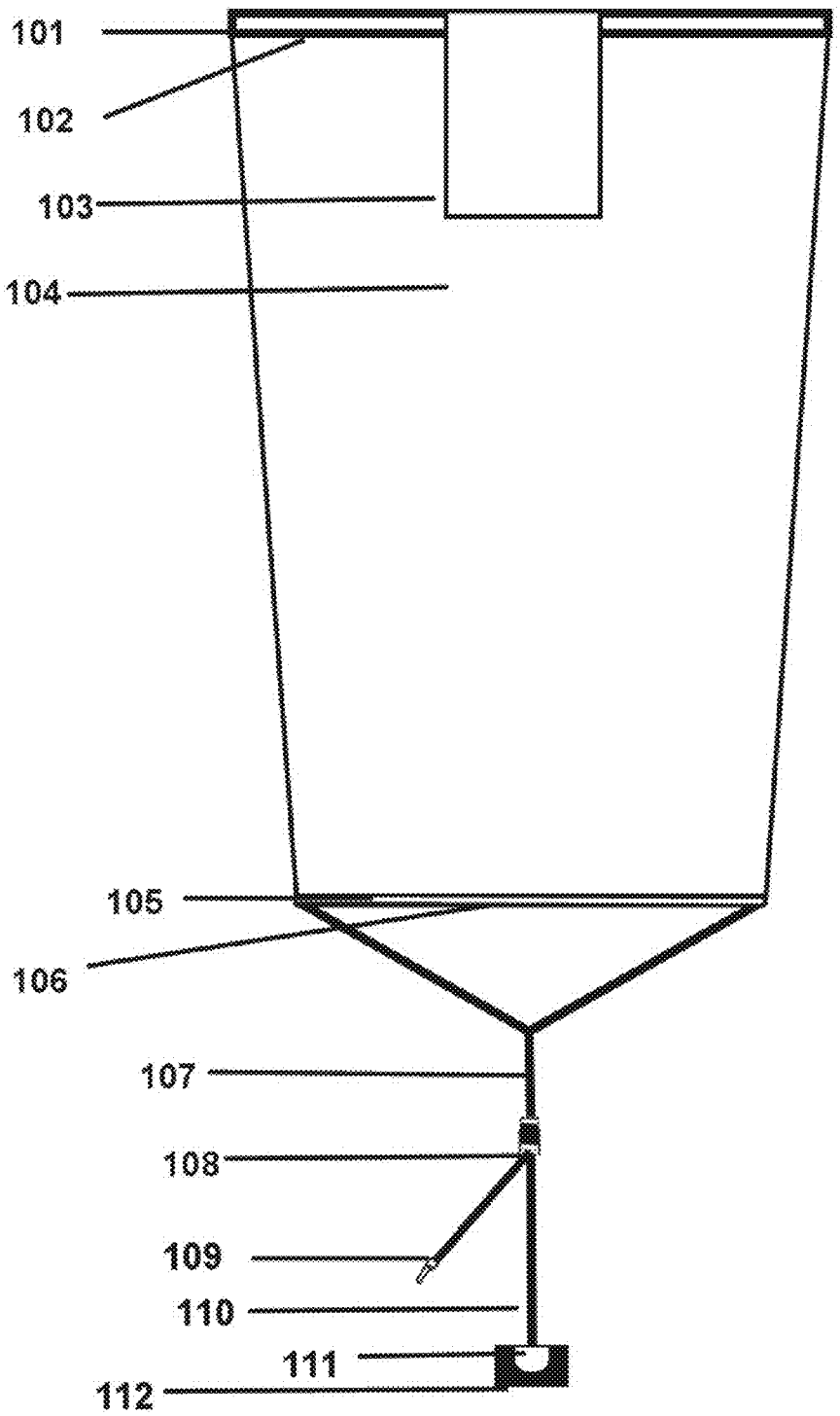
FIG. 1 is a diagrammatic, front-elevational view of a wind paddle sail assembly according to the invention.

Referring now to the figures of the drawing in detail and first, particularly, to FIG. 1 thereof, there is seen a wind paddle sail assembly according to the invention which includes a sail 104 made of a sailcloth fabric such as Dacron or Nylon and which may have multiple layers of woven or film material or any other standard sailcloth. The sail 104 has a yard pole pocket 101 enclosing a rigid yard pole 102 and a paddle blade pocket 103, both disposed at the top or upper end of the sail 104. The pocket 103 has a mesh cover so as to allow water to quickly flow out of the pocket. A foot pole pocket 105 enclosing a flexible foot pole 106 is disposed at the bottom or lower end of the sail 104. A downhaul strap, which may be made of webbing material, is provided for adjusting the tension in the sail 104. The downhaul strap is formed of two parts. The first part of the downhaul strap is a Y-shaped upper downhaul strap 107 having two upper ends each being attached to the sail 104 near a respective end of the foot pole pocket 105 and a lower end having one-half of an adjustable release clip 108. The second part of the downhaul strap includes a lower downhaul strap 110 formed in one piece with a downhaul safety strap 109. The upper end of the lower downhaul strap 110 has the other half of the adjustable release clip 108 and the lower end of the lower downhaul strap 110 has a handle grip pocket 112 with a notched handle opening 111. The downhaul safety strap 109 has a carabiner clip 314 at the end thereof. It is understood that any type of clip may be used instead of the carbiner clip, as mentioned above.

Figure 10A:
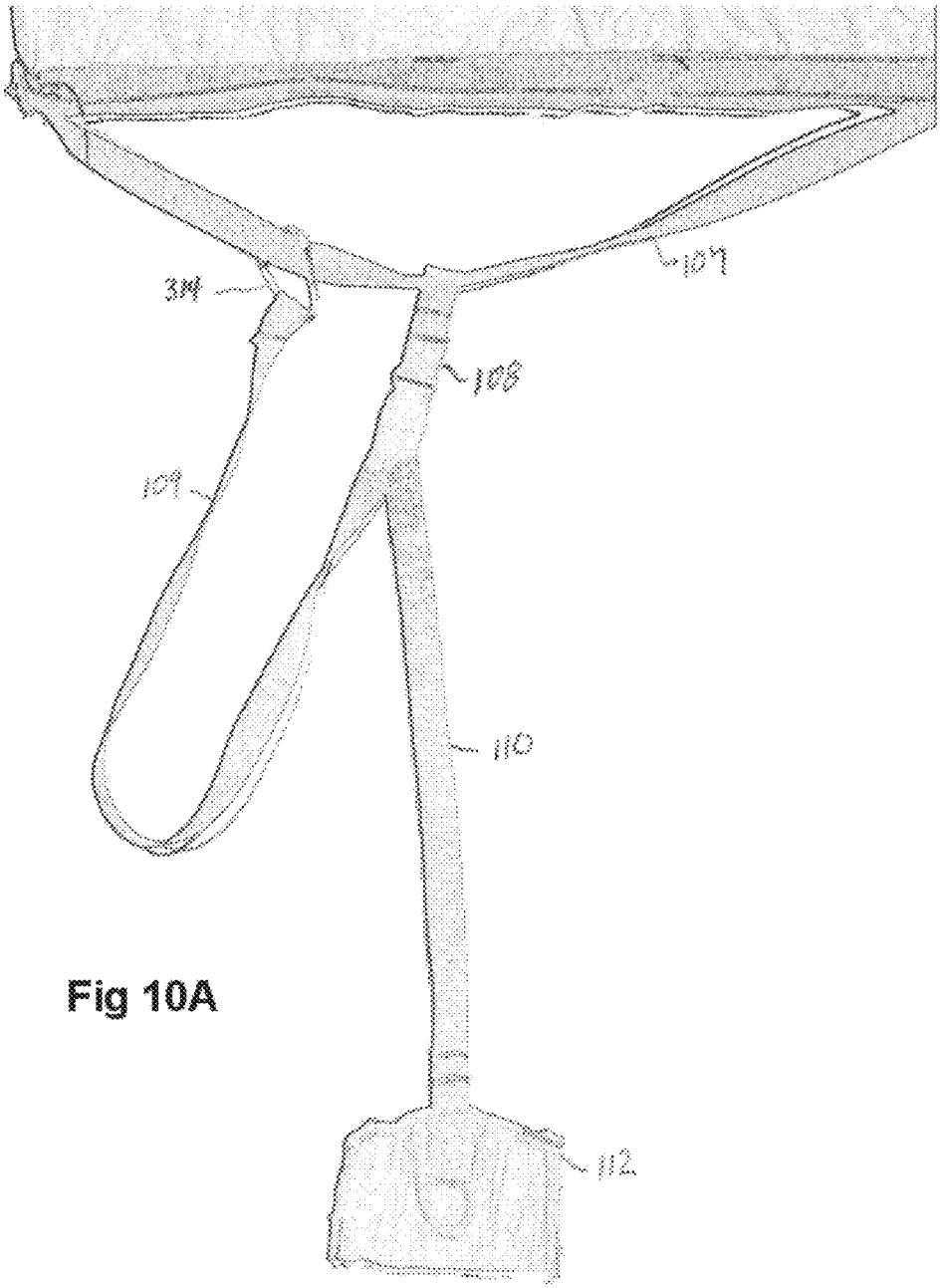
FIGS. 10A, 10B and 10C are is an enlarged top-plan views showing details of the downhaul strap.
Figure 10B:
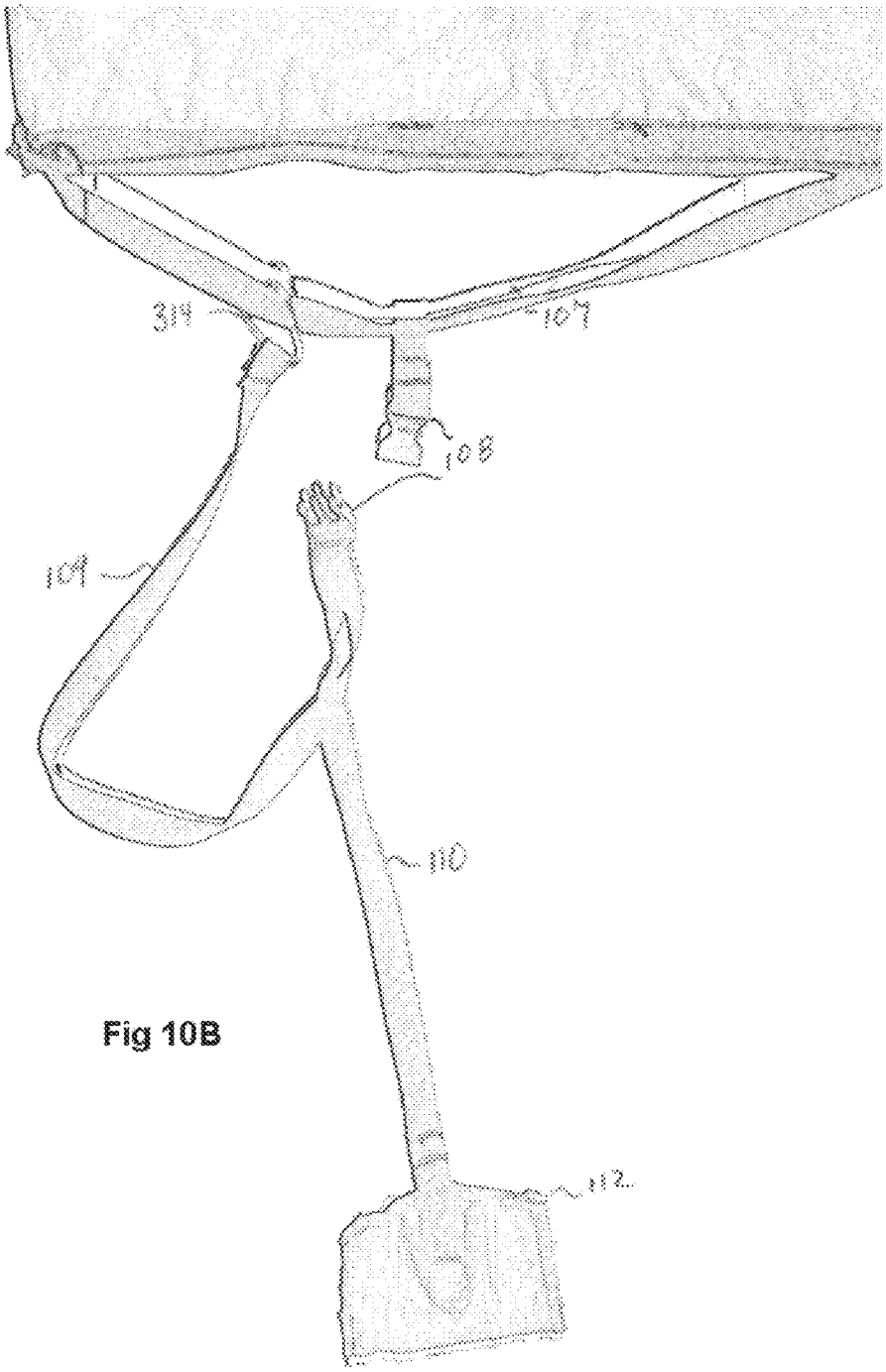
Figure 10C:
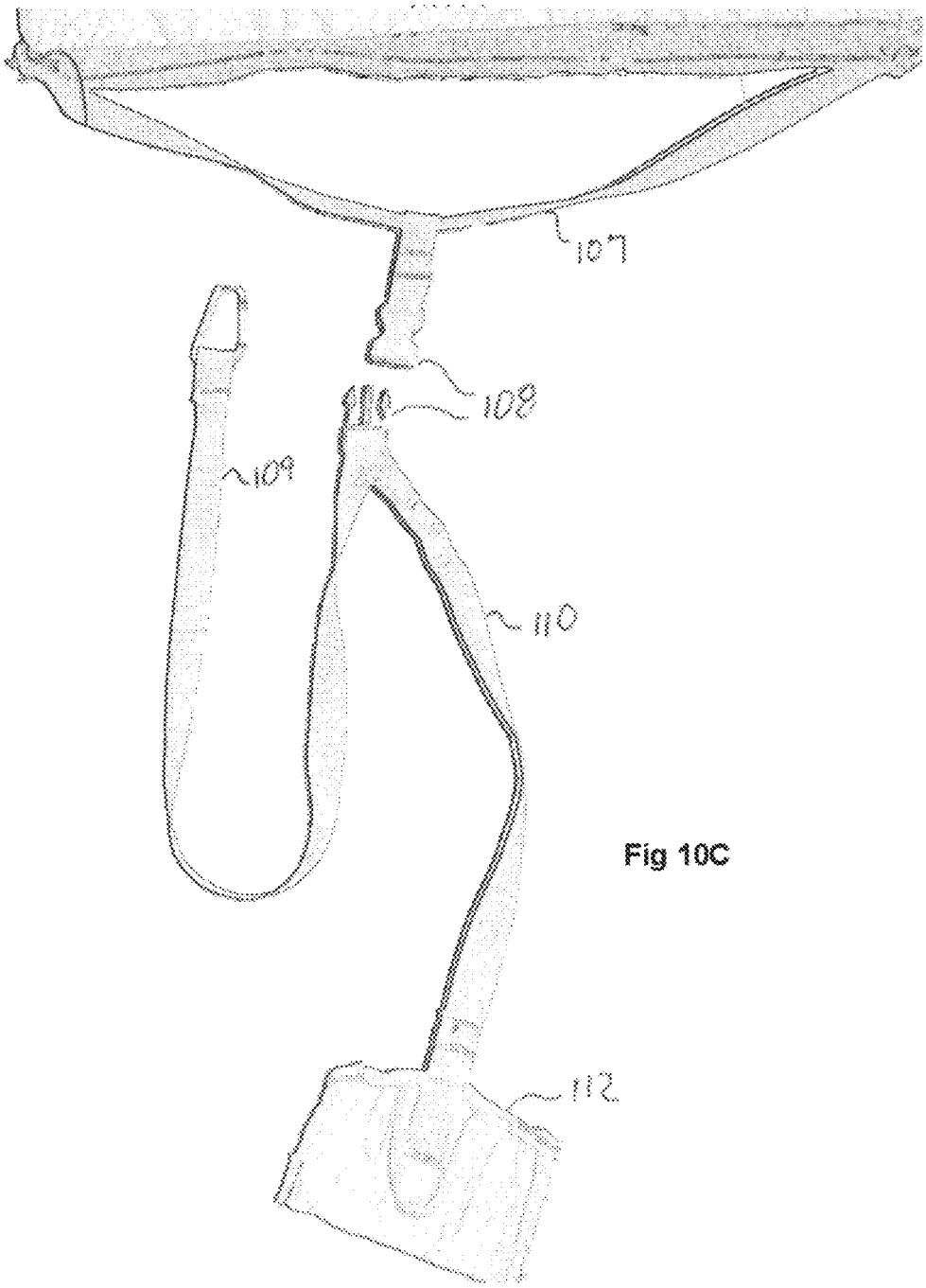

FIG. 10A shows the lower downhaul strap 110 attached to the upper downhaul strap 107 at the adjustable release clip 108. The downhaul safety strap 109, which is part of the lower downhaul strap 110, has a loop sewn at an adjustable slack end thereof which receives a safety leash clip in the form of a carabiner clip 314 that is dipped to the upper downhaul strap 107. FIG. 10B shows the adjustable release clip 108 being opened and the safety leash clip 314 which remains attached, resulting in a leash configuration. FIG. 10C shows the carabiner clip 314 being unclipped as well. Although the adjustable release clip 108 is shown with the female end on the upper downhaul strap 107 and the male end on the lower downhaul strap 110, the female and male ends may be reversed.

Figure 2:
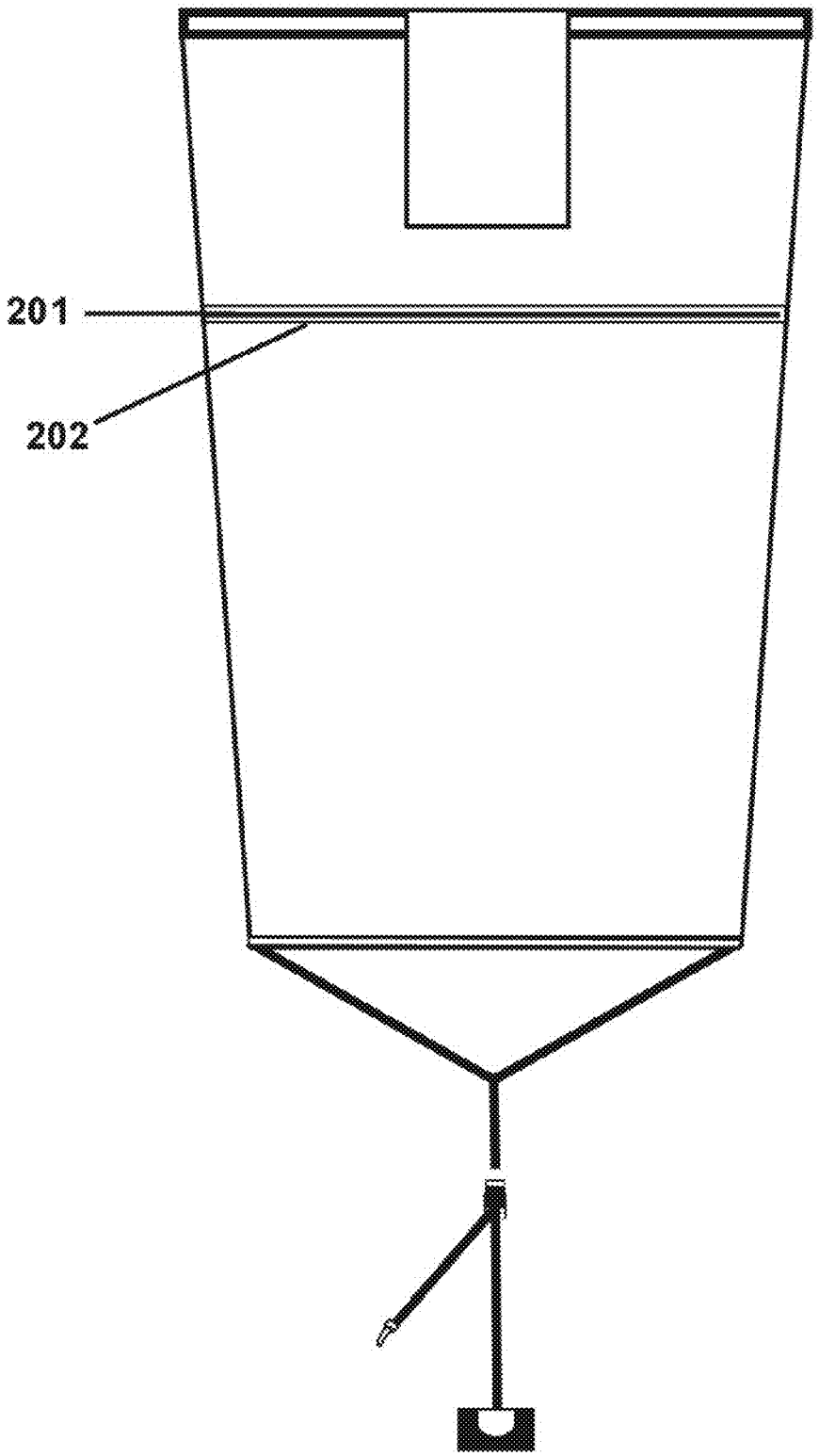
FIG. 2 is a view similar to FIG. 1 showing the wind paddle sail assembly with an optional batten pocket.

FIG. 2 shows the sail 104 with an optional batten pocket 201 for sail battens 102 used to stiffen the shape of the sail.

Figure 3:
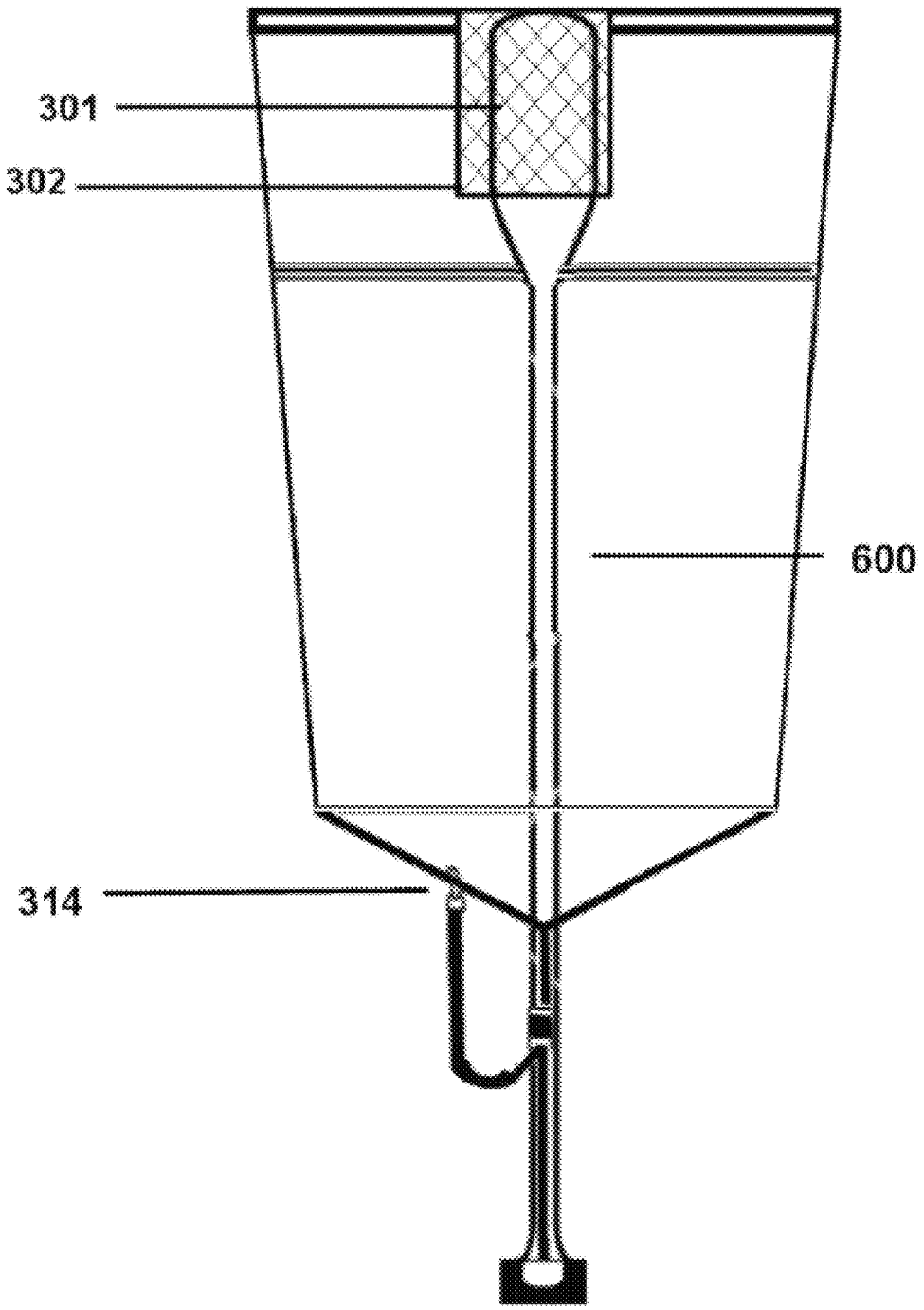
FIG. 3 is a front-elevational view similar to FIG. 1 with a paddle having a T bar grip and a blade in a pocket.
Figure 9A:
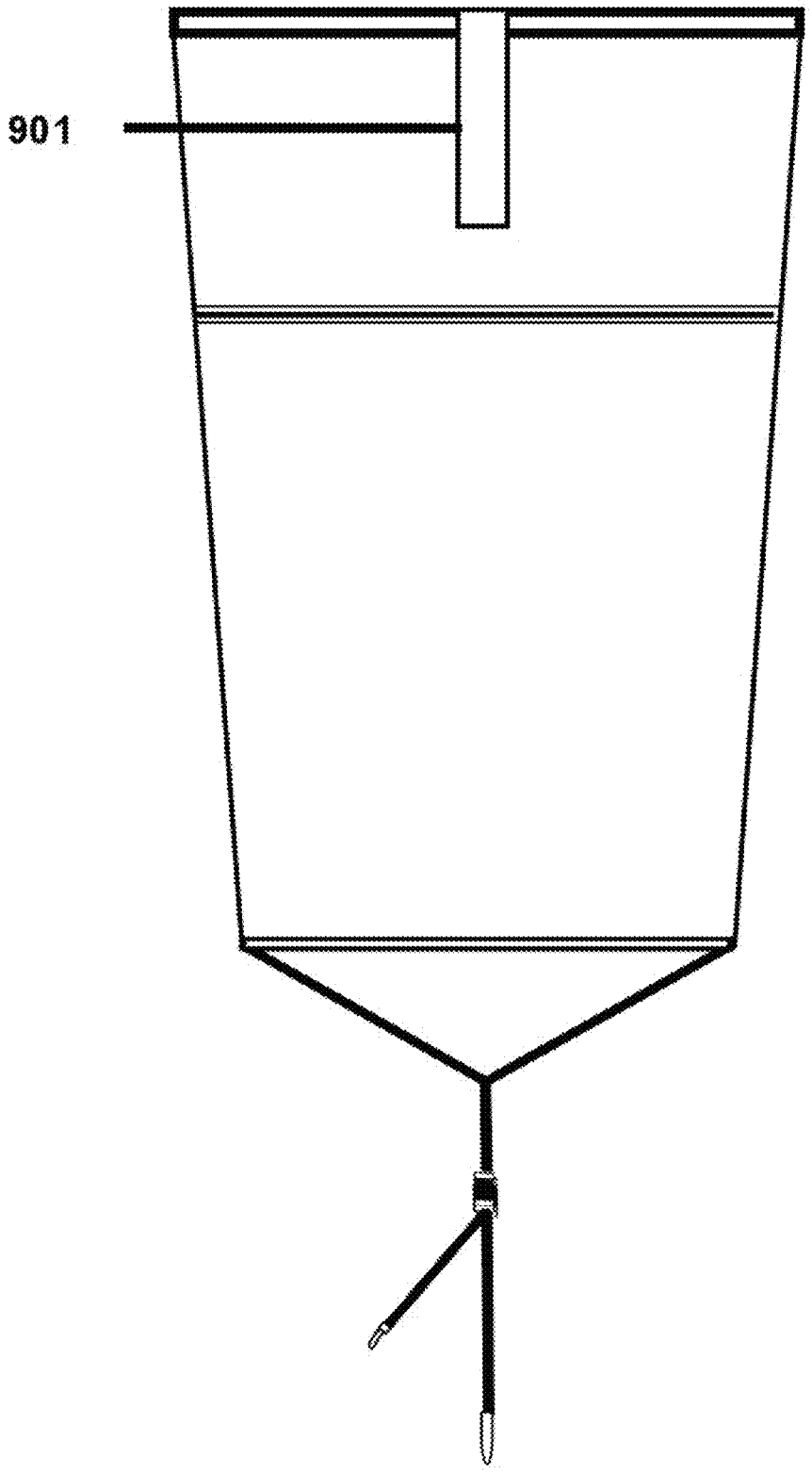
FIG. 9A is a front-elevational view of the sail with a pocket for a mast pole.
Figure 9B:
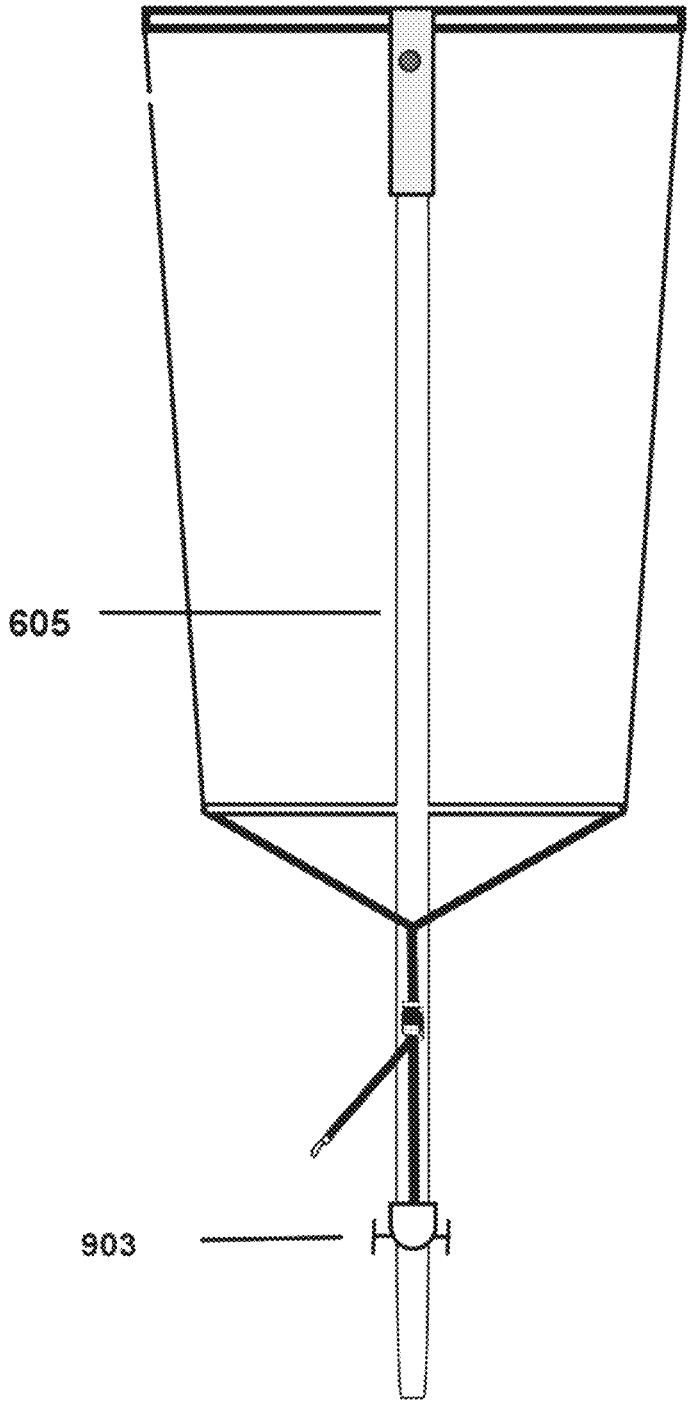
FIG. 9B is a front-elevational view similar to FIG. 1 showing a pole having one end in a pocket of the sail and another end in a pole mount.
Figure 9C:
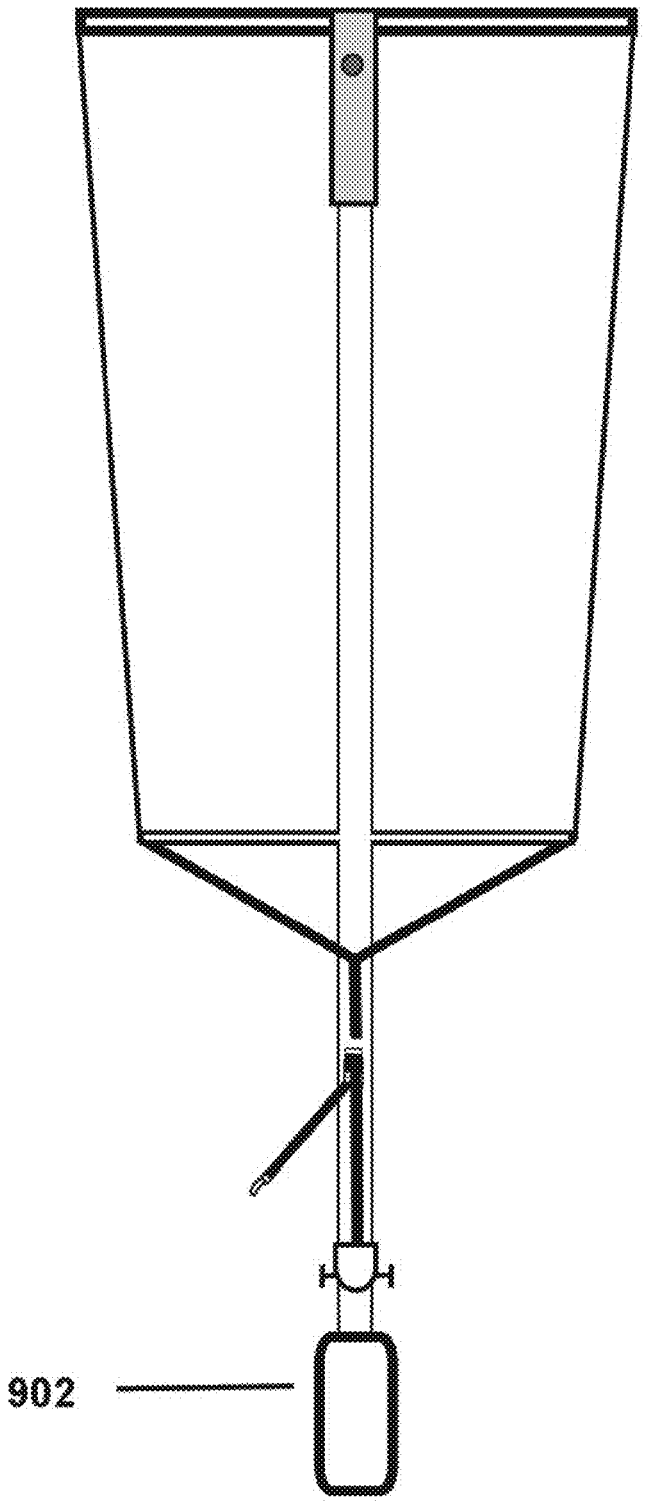
FIG. 9C is a front-elevational view similar to FIG. 9B showing a pole having one end in a pocket of the sail and another end in a holder mount.

FIG. 3 shows the sail 104 with a paddle blade pocket 301 having a mesh material 302 for receiving a blade at an upper end of a paddle 600. The figure also shows the carabiner clip 314 of the downhaul safety or cordage anchor strap 109 attached to the upper downhaul strap 107. It can also be seen that a T bar at the lower free end of the paddle 600 is disposed in the notched, U-shaped handle opening 111 of the handle grip pocket 112. The lower downhaul strap 110 is attached to the lower portion of the paddle 600 which has the lower free end. The paddle 600 could also be replaced by a simple mast pole, bar or dowel 605 having an upper fixed end in a pocket 901 shown in FIG. 9A and a lower free end in the handle grip pocket 112 or fixed in a mast pole mount 903 shown in FIG. 9B or in a mast pole base holder mount 902 shown in FIG. 9C. The term upper fixed end of the paddle means that a fastener, such as the pocket 103, 301, fastens the upper fixed end of the paddle to the upper end of the sail 104. The term lower free end of the paddle means that the lower free end is not attached to a watercraft. The mast pole, bar or dowel 605 and the paddle 600 may be referred to in general as a shaft 500.

Figure 4:
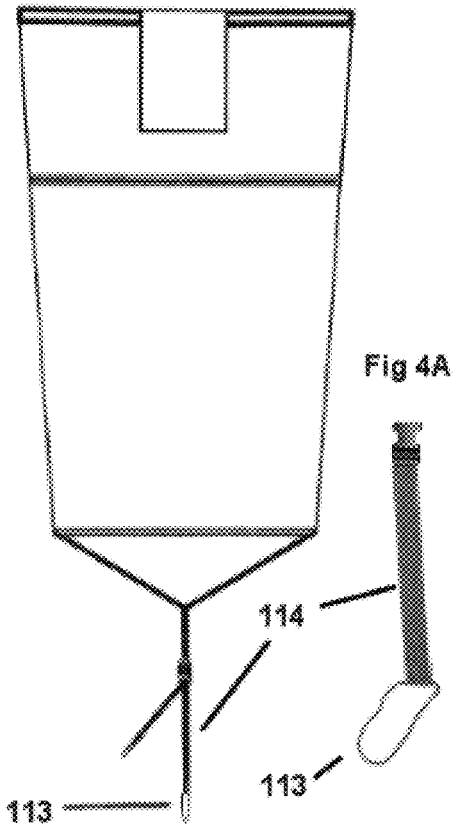
FIG. 4 is a front-elevational view similar to FIG. 1 with an anchor strap having a cordage loop at the end.

FIG. 4 is another view of the sail 104 having the upper downhaul strap 107, the lower downhaul strap 110, the adjustable release clip 108 and the downhaul safety strap 109. In addition, an alternate lower downhaul safety strap 114, which is shown in FIG. 4 and in an enlarged view in FIG. 4A, has a cordage loop 113 at the lower end for attachment to a notch in a paddle or in a mast pole when a paddle with a blade is not being used.

Figure 5:
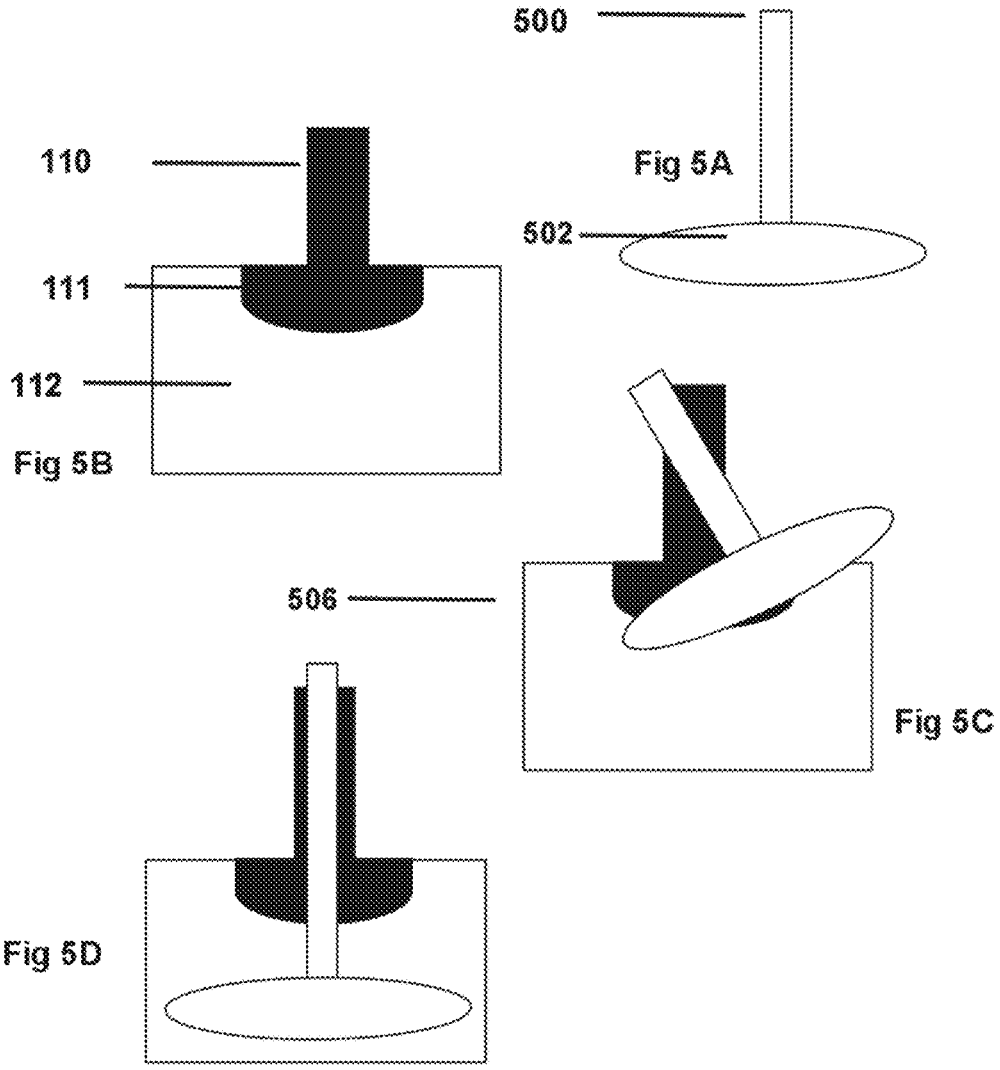
FIGS. 5A, 5B, 5C and 5D are fragmentary, front-elevational views of a T bar grip of the paddle in various stages of placement into a handle grip pocket.

FIG. 5A shows the shaft 500 having a T bar grip 502 at one end. FIG. 5B shows the handle grip pocket 112 having the notched, U-shaped handle opening 111 and the lower downhaul strap 110. FIG. 5C shows the operation 506 of installing the T bar grip 502 into the notched, U-shaped handle opening 111 of the handle grip pocket 112. The installed position of the T bar grip is seen in FIG. 5D.

Figure 6A:
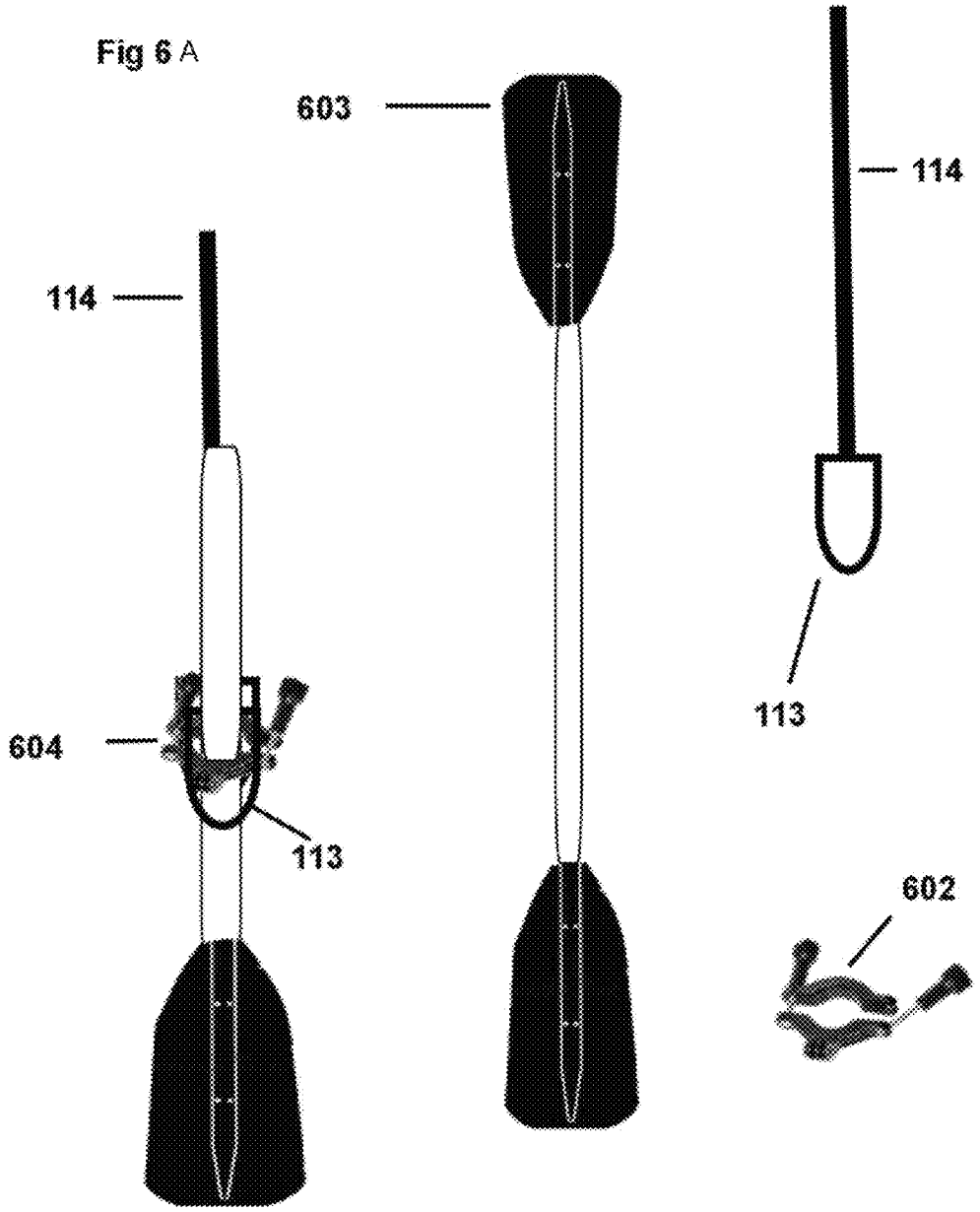
FIG. 6A includes a group of front-elevational views of paddles and a perspective view of a mounting bar clamp.

FIG. 6A shows various paddles to be used with the sail 104 to form a wind paddle sail assembly. More specifically, a paddle 603 has blades at both ends. A paddle 604 is also shown with a mounting bar clamp 602 on the shaft of the paddle. The mounting bar clamp 602 permits the cordage loop 113 of the alternate downhaul safety anchor strap 114 (which is also shown in FIG. 6A) to be attached to the shaft of the paddle because there is no T bar to be held in the handle grip pocket. As mentioned above, this permits a simple mast pole, bar or dowel to be used in place of a paddle.

Figure 6B:
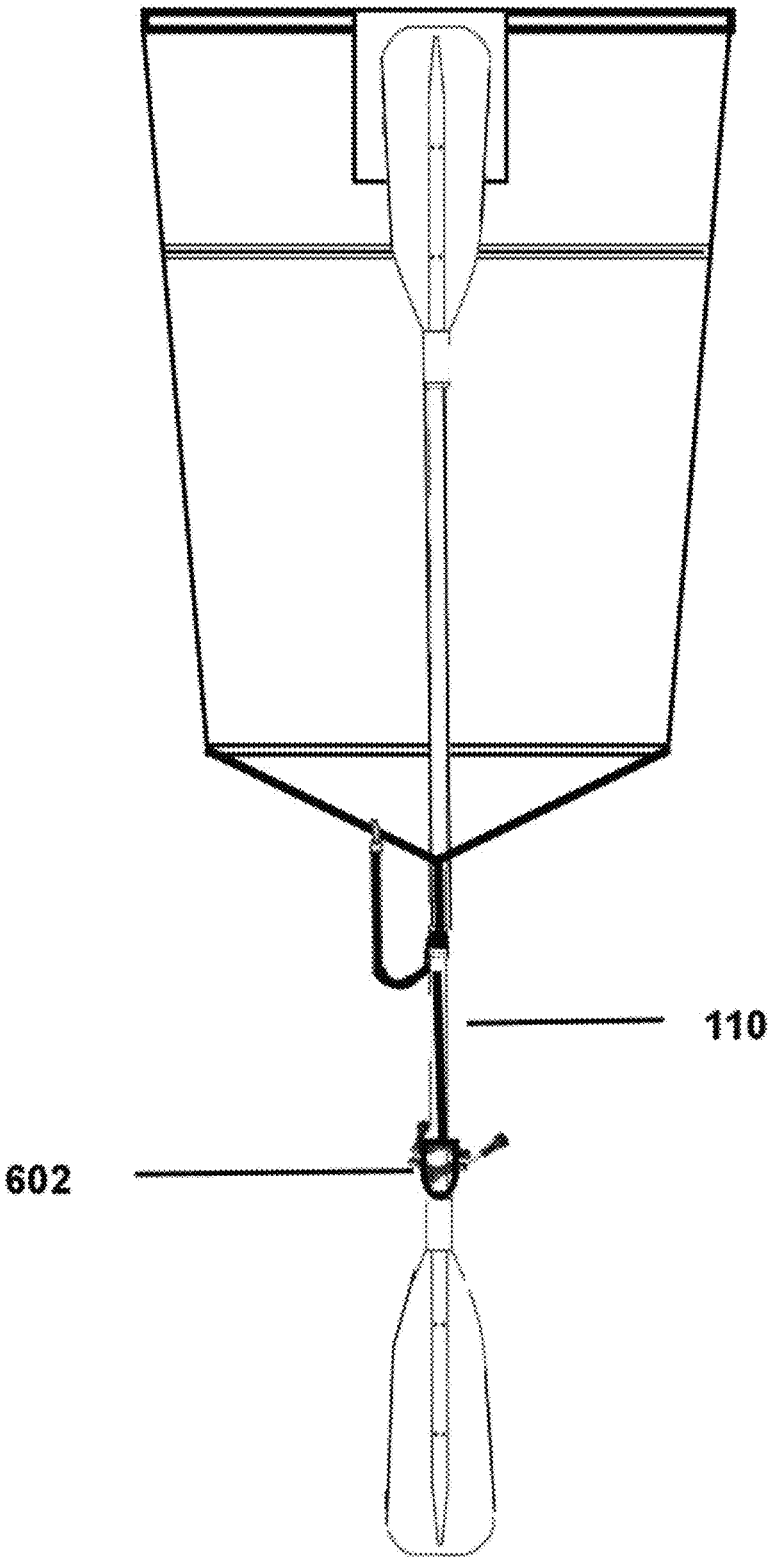
FIG. 6B is a front-elevational view similar to FIG. 1 with a paddle having two blades.

FIG. 6B shows the paddle having two blades and the mounting bar clamp 602 of FIG. 6A, to which the cordage loop 113 of the alternate downhaul strap 114 is attached.

Figure 6C:
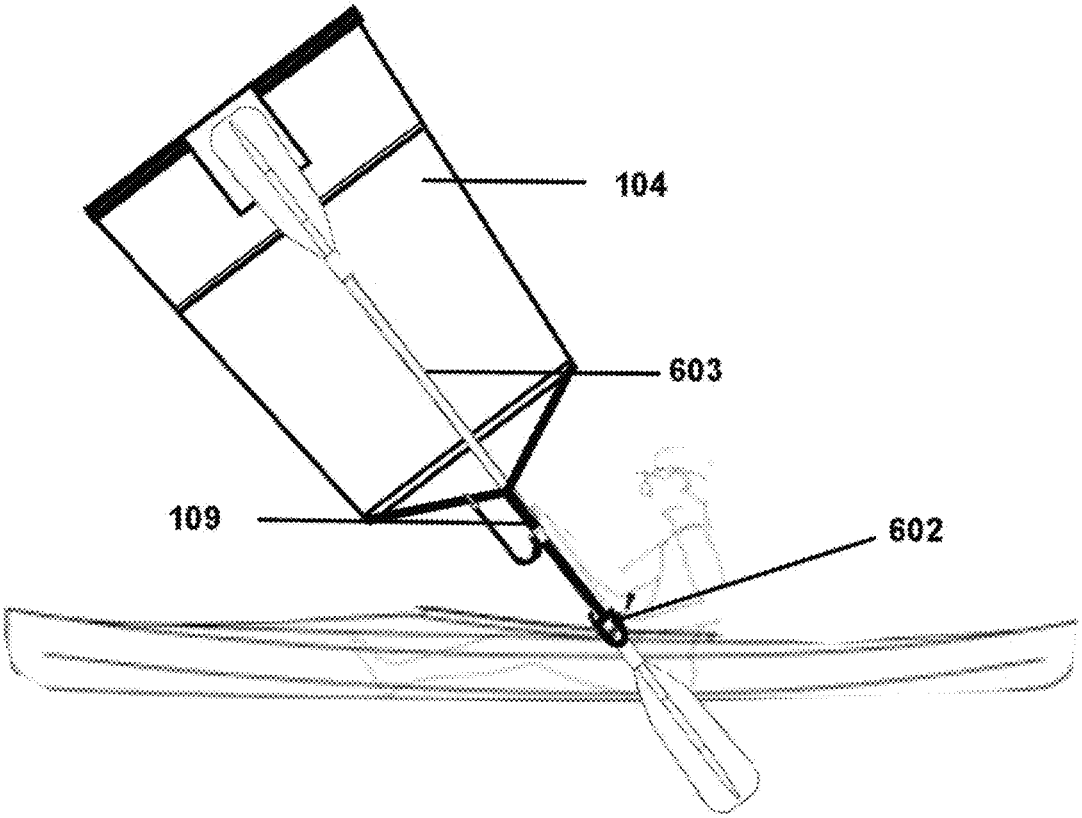
FIG. 6C is a front-elevational view of the wind paddle sail mounted on a paddle having two blades and being used by a person on a watercraft.

FIG. 6C illustrates the operation of the wind paddle sail assembly with a watercraft such as a kayak. In the figure, a person is sitting in or on the kayak and is using the wind paddle sail assembly to move the kayak with the force of the wind. It can be seen that a double-blade paddle 603 has one of its blades in the pocket of the sail 104 while the other blade is either above the water or is immersed in the water to act as a rudder. The cordage loop 113 of the alternate downhaul safety anchor strap 114 is attached to the mounting bar clamp 602 on the shaft of the paddle. The operator of the watercraft places one hand on the paddle 603 in the vicinity of the mounting bar clamp 602 and the other hand in the vicinity of the adjustable release clip 108 so as to be able to adjust the tension in the sail by lengthening or shortening the downhaul strap.

Figure 7A:
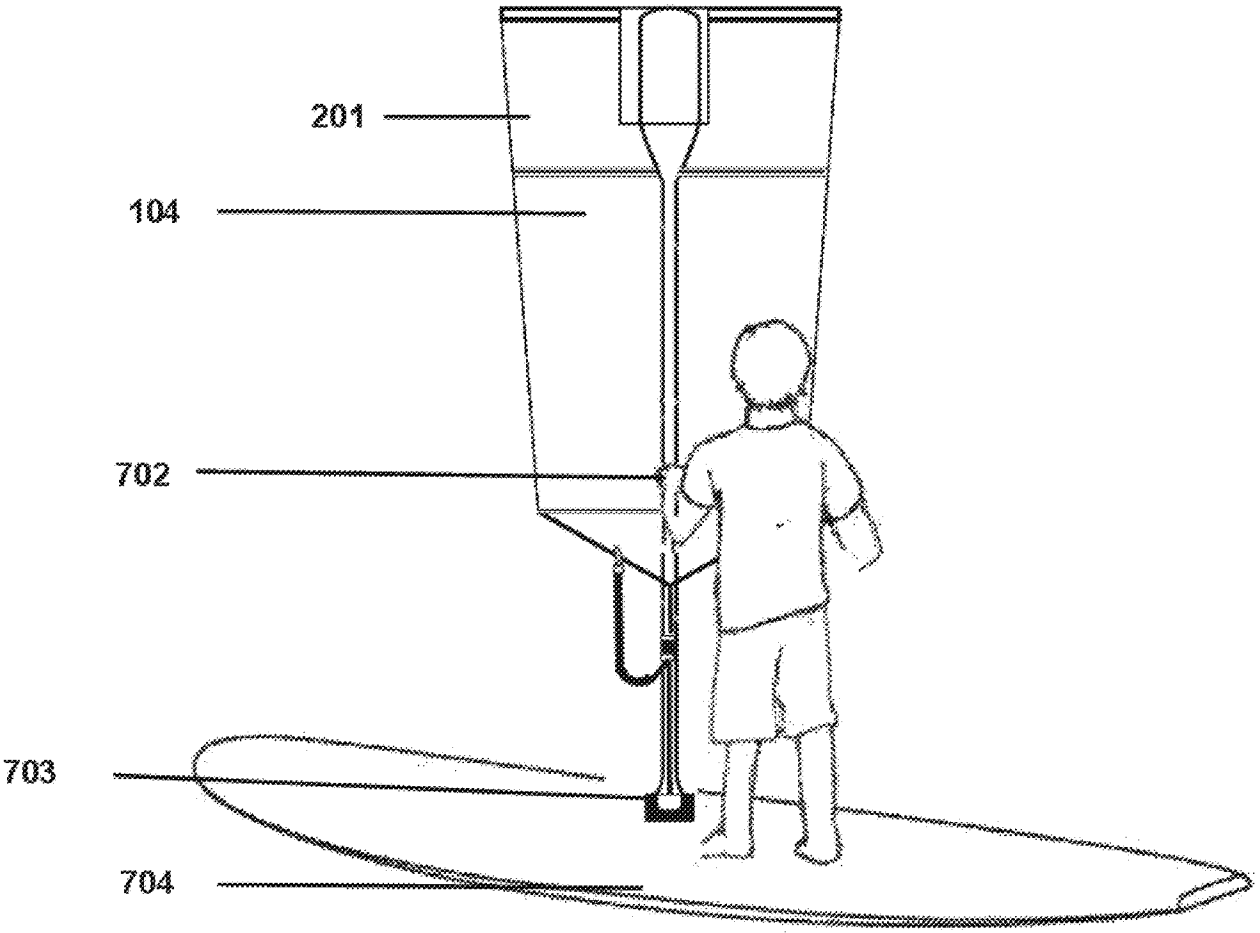
FIG. 7A is a perspective view of a wind paddle sail mounted on a paddle having a T bar grip and a blade and being used by a person on a watercraft on which the T bar grip rests.
Figure 7B:
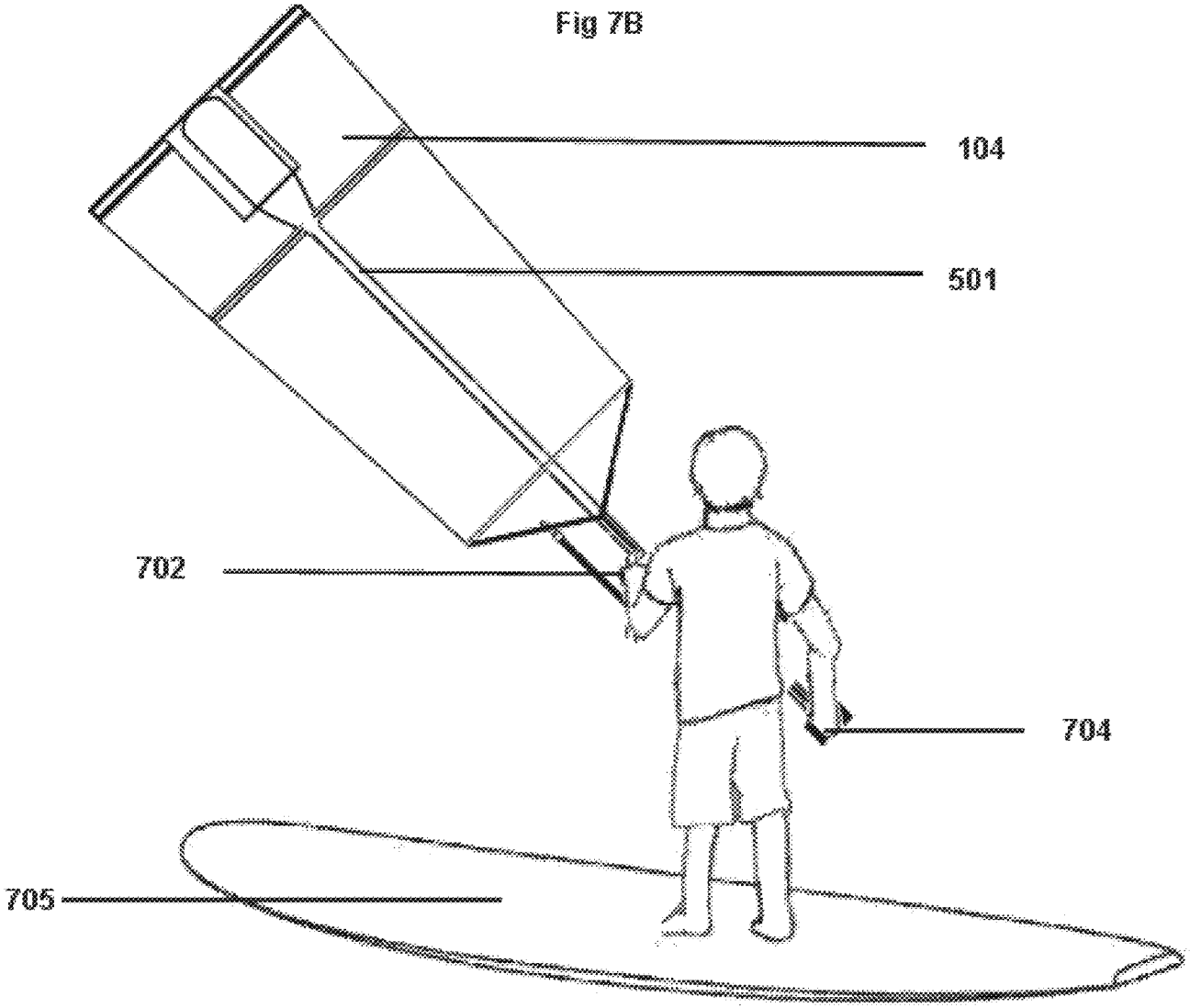
FIG. 7B is a perspective view of a wind paddle sail mounted on a paddle having a T bar grip and a blade and being used by a person on a watercraft in which the T bar grip is held by the person's hand.

FIG. 7A illustrates the operation of the wind paddle sail assembly with a watercraft such as a stand-up paddle board (SUP) 705. The paddle has a blade at the upper end which is disposed in the pocket of the sail 104 and a T bar grip at the lower end which is disposed the notched, U-shaped handle opening of the handle grip pocket to act as a movable board mount 703 which is not attached to the watercraft. The sail has a batten pocket 201. One hand 702 of the operator is used to steer the watercraft by turning and tilting the wind paddle sail assembly which includes the sail and the paddle. FIG. 7B shows the other hand 704 of the operator holding the handle grip pocket receiving the T bar grip of the paddle shaft 501 so that the wind paddle sail assembly is held above the watercraft to catch the desired amount of wind.

Figure 7C:
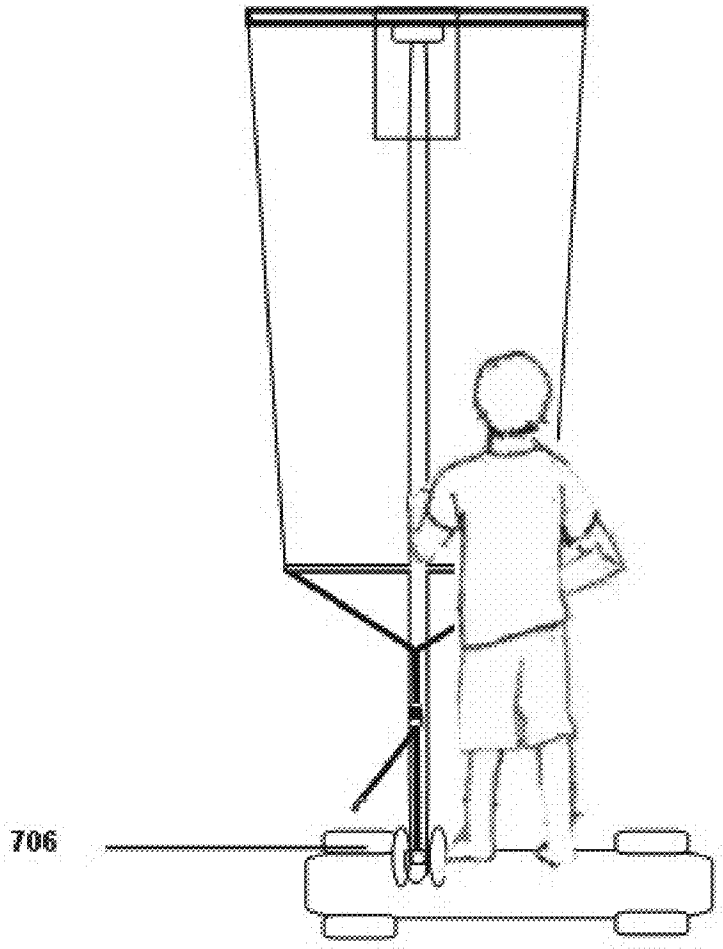
FIG. 7C is a perspective view of a wind paddle sail mounted on a pole and being used by a person on a skateboard.
Figure 9D:
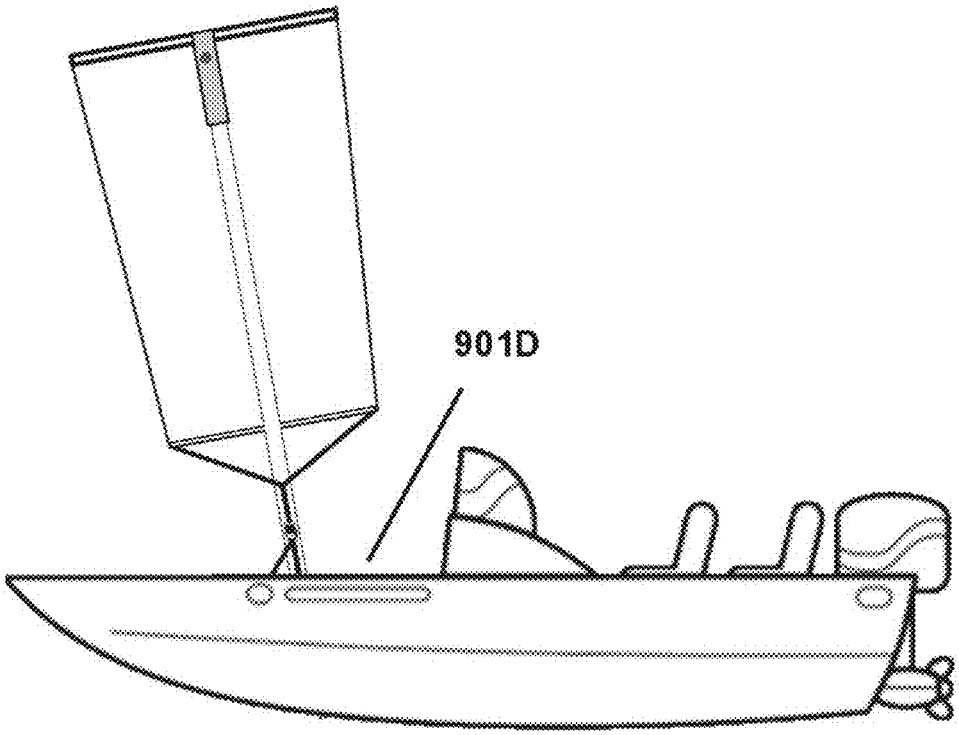
FIG. 9D is a perspective view of the wind paddle sail assembly being used on a motorized watercraft.

Similarly, FIG. 7C shows the wind paddle sail assembly being used with a skateboard 706 and FIG. 9D illustrates the operation of the wind paddle sail assembly with a motorized watercraft 707 in a drifting mode.

Figure 8A:
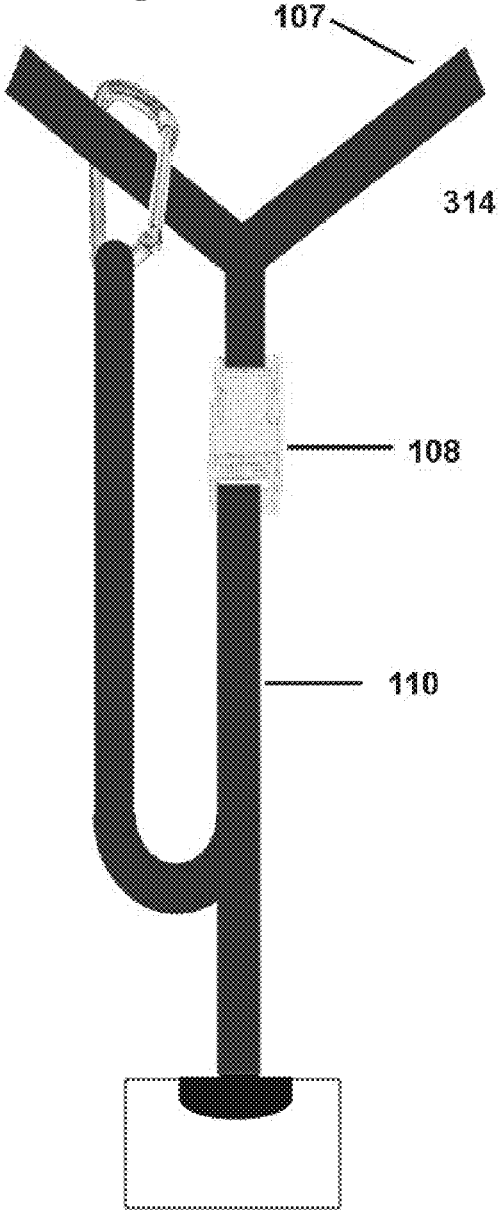
FIGS. 8A and 8B are enlarged, top-plan views of an upper downhaul strap being alternatively connected to a lower downhaul strap and to downhaul safety strap with a carabiner clip.
Figure 8B:
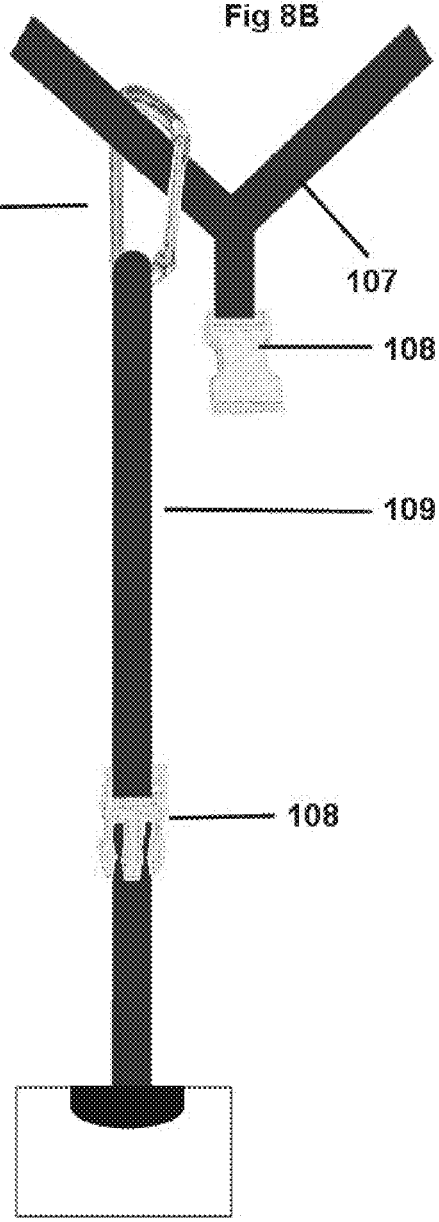

FIGS. 8A and 8B are enlarged, top-plan views of the downhaul strap. In FIG. 8A, the upper downhaul strap 107 is connected by the adjustable release clip 108 to the lower downhaul strap 110 and the downhaul safety anchor strap 109. In FIG. 8B, the release clip 108 has been opened to release the one-piece lower downhaul strap 110 and downhaul safety anchor strap 109, but the downhaul safety anchor strap 109 is attached to the upper downhaul strap 107 by the carabiner clip 314 to prevent the strap 110, 109 from falling into the water and becoming lost. In FIGS. 8A and 8B, the lower end of the lower downhaul strap 110 is attached to the handle grip pocket 112 having the notched, U-shaped handle opening 111.

The invention claimed is:

1. A wind paddle sail assembly, comprising:

a sail for propelling a land or water vehicle, said sail having stiffened upper and lower ends;

a paddle having an upper fixed end with a blade and a lower portion with a lower free end being free of said sail;

a pocket disposed at said upper end of said sail for receiving and fastening said upper fixed end of said paddle to said upper end of said sail; and a downhaul strap fastening said lower end of said sail to said lower portion of said paddle for adjusting tension in said sail.

2. The wind paddle sail assembly according to claim 1, wherein said downhaul strap includes an upper downhaul strap attached to said lower end of said sail, a lower downhaul strap attached to said paddle, and a release clip interconnecting said upper and lower downhaul straps, said release clip permitting adjustment of a length of said downhaul strap.

3. The wind paddle sail assembly according to claim 2, which further comprises a downhaul safety strap formed in one piece with said lower downhaul strap, said downhaul safety strap having a free end with a clip for attachment to said upper downhaul strap.

4. The wind paddle sail assembly according to claim 2, wherein, a handle grip pocket is disposed at a lower end of said lower downhaul strap, and said handle grip pocket has a notched, U-shaped handle opening for receiving a T bar disposed at said lower free end of said paddle.

5. The wind paddle sail assembly according to claim 2, which further comprises a mounting bar clamp clamped to said paddle between said upper fixed end and said lower free end of said paddle, and an anchor strap having one end for attachment to said release clip and another end with a cordage loop for attachment to said mounting bar clamp.

6. The wind paddle sail assembly according to claim 2, which further comprises an anchor strap having one end for attachment to said release clip and another end with a cordage loop for attachment to said paddle.

7. The wind paddle sail assembly according to claim 6, wherein said cordage loop may be attached to a notch in said paddle.

8. The wind paddle sail assembly according to claim 1, which further comprises a yard pole pocket enclosing a rigid yard pole at said upper end of said sail, and a foot pole pocket enclosing a flexible foot pole at said lower end of said sail.

9. The wind paddle sail assembly according to claim 1, wherein said sail has a batten pocket, and a sail batten is disposed in said batten pocket.

10. A method for operating a wind paddle sail assembly, the method comprising the following steps:

providing a sail having stiffened upper and lower ends;

providing a paddle having an upper fixed end with a blade and a lower portion with a lower end being free of the sail;

using a pocket disposed at the upper end of the sail to receive and fasten the blade and to fasten the upper fixed end of the paddle to the upper end of the sail;

using a downhaul strap to fasten the lower end of the sail to the lower portion of the paddle;

using the downhaul strap to adjust tension in the sail; and holding the lower portion of the paddle with one hand and steering the sail with the other hand while occupying a land or water vehicle to propel and steer the vehicle with the wind.

11. The method according to claim 10, which further comprises:

providing the downhaul strap with an upper downhaul strap attached to the lower end of the sail, a lower downhaul strap attached to the paddle, and a release clip interconnecting the upper and lower downhaul straps; and carrying out the step of adjusting tension in the sail by adjusting a length of the downhaul strap.

12. The method according to claim 11, which further comprises providing a downhaul safety strap formed in one piece with the lower downhaul strap, the downhaul safety strap having a free end with a clip, and attaching the free end of the clip to the upper downhaul strap.

13. The method according to claim 11, which further comprises providing a paddle as the paddle, fastening a handle grip pocket at a lower end of the lower downhaul strap, providing the handle grip pocket with a notched, U-shaped handle opening, and inserting a T bar disposed at the lower free end of the paddle in the notched handle opening.

14. The method according to claim 11, which further comprises clamping a mounting bar clamp to the paddle between the upper fixed end and the lower free end of the paddle, and attaching a cordage loop of an anchor strap to the mounting bar clamp.

15. The method according to claim 11, which further comprises attaching one end of an anchor strap to the release clip and attaching a cordage loop at another end of the anchor strap to the paddle.

16. The method according to claim 15, which further comprises attaching the cordage loop to a notch in the paddle.

17. The method according to claim 10, which further comprises providing a yard pole pocket enclosing a rigid yard pole to stiffen the upper end of the sail, and providing a foot pole pocket enclosing a flexible foot pole at the lower end of the sail.

18. The method according to claim 10, which further comprises providing the sail with a batten pocket, and placing a sail batten in the batten pocket.

* * * * *